US005110775A

United States Patent [19]

Owen

[11] Patent Number: 5,110,775

[45] Date of Patent: May 5, 1992

[54] TWO STAGE COMBUSTION PROCESS FOR CRACKING CATALYST REGENERATION

[75] Inventor: Hartley Owen, Belle Mead, N.J.

[73] Assignee: Mobil Oil Corporation, Fairfax, Va.

[21] Appl. No.: 635,437

[22] Filed: Dec. 28, 1990

[51] Int. Cl.[5] ..... B01J 38/34; B01J 38/36; B01J 29/38; C10G 11/18

[52] U.S. Cl. ..... 502/43; 208/113; 208/120; 208/164; 422/144; 502/42; 502/44

[58] Field of Search ..... 502/40–44; 208/113, 120, 164

[56] References Cited

U.S. PATENT DOCUMENTS

| | | | |
|---|---|---|---|
| 2,861,947 | 11/1958 | Nicholson | 502/40 |
| 4,289,605 | 9/1981 | Bartholic | 208/164 |
| 4,861,741 | 8/1989 | Herbst et al. | 208/120 |
| 4,895,636 | 1/1990 | Chen et al. | 208/113 |
| 4,980,050 | 12/1990 | Huh et al. | 208/113 |

*Primary Examiner*—Paul E. Konopka
*Attorney, Agent, or Firm*—A. J. McKillop; C. J. Speciale; Richard D. Stone

[57] ABSTRACT

A two-stage process and apparatus for the regeneration of fluidized catalytic cracking (FCC) catalyst is disclosed. A primary regenerator, a single dense bed with a spent catalyst inlet, a source of oxygen-containing gas, a flue gas outlet and a regenerated catalyst outlet, is supplemented with a secondary regenerator. The secondary regenerator has its own source of air for combustion and takes particles from a lower portion of the dense bed in the primary regenerator. Combustion gases, and some solids, are discharged from the secondary regenerator into the primary regenerator. Hot, decoked material is withdrawn from the base of the secondary regenerator for use in the catalytic cracking reaction. Preferably, a dense, fast settling additive is used with a conventionally sized FCC catalyst. These two materials can be added together to the primary regenerator and separated by elutriation therein into two catalyst phases. Preferably most of the conventionally sized FCC catalyst is regenerated in the primary regenerator, while most of the denser additive is decoked in the secondary regenerator. Additive can be used to thermally shock heavy feeds, such as a resid, and remove a majority of the coke and metal contaminants of the resid upstream of a riser cracking reaction zone wherein the conventionally sized FCC catalyst is added.

8 Claims, 1 Drawing Sheet

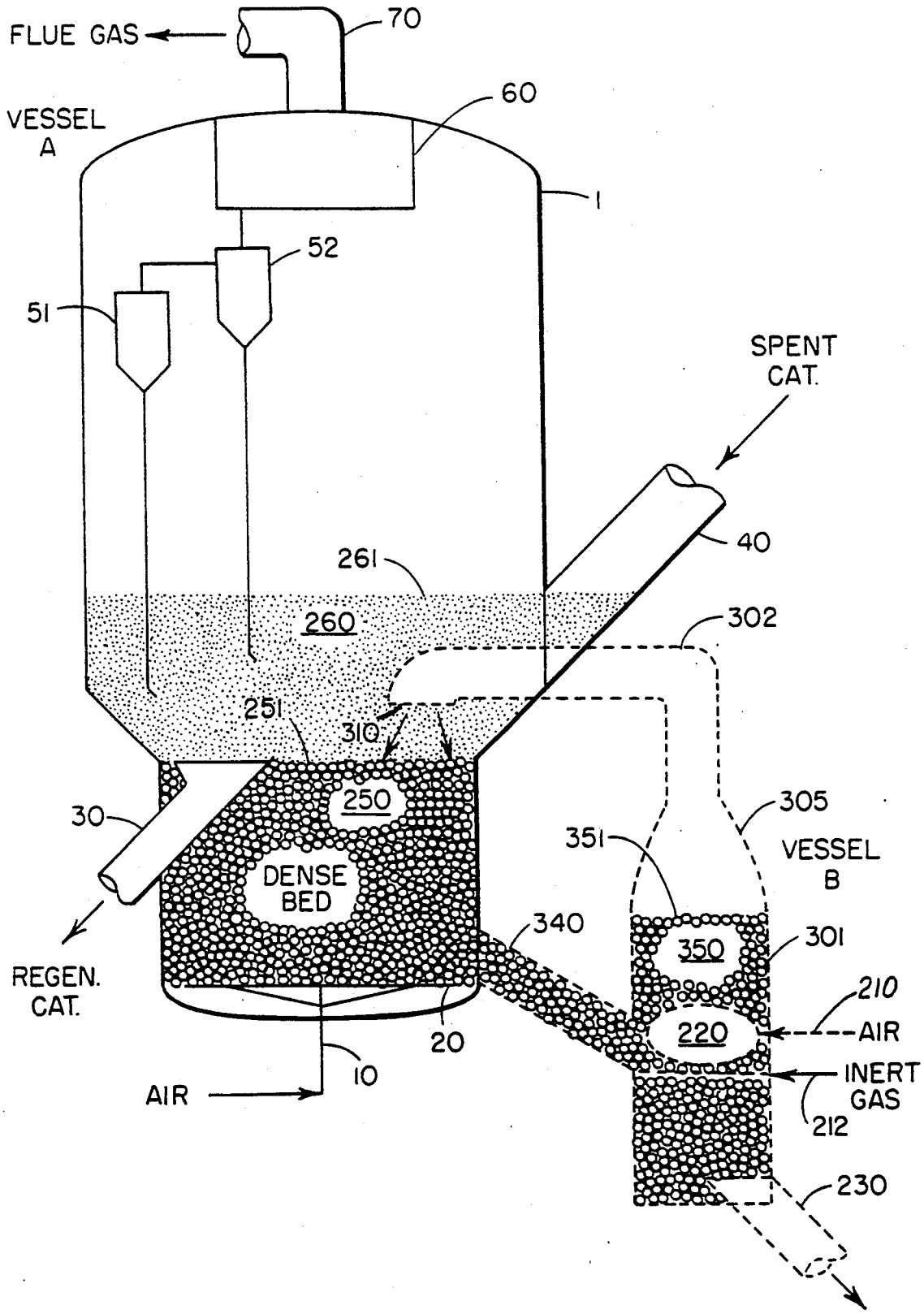
FLUE GAS
70
60
VESSEL A
1
52
51
SPENT CAT.
40
261
260
302
251
310
250
30
305
351
VESSEL B
DENSE BED
340
350
301
REGEN. CAT.
210
220
AIR
20
10
INERT GAS
AIR
212
230

TWO STAGE COMBUSTION PROCESS FOR CRACKING CATALYST REGENERATION

BACKGROUND OF THE INVENTION

The FCC, or fluidized catalytic cracking process, is a mature process. It is used to convert relatively heavy, usually distillable, feeds to more valuable lighter products. There is an increasing need in modern refineries to convert more of the "bottom of the barrel" to more valuable lighter products, e.g., resids or residual oil fractions.

In the past these heavy streams were subjected to various thermal processes such as coking or visbreaking to convert them to more valuable products. Unfortunately, thermal processing alone has not proved to be a complete answer to the problem, as the products of thermal cracking are themselves relatively low valued products, such as heavy fuel oil from visbreaking or coker naphtha or coker gas oil from coking operations. In the case of coking, very large coke yields result in large volumes of low value product.

Residual oils have a large percentage of refractory components such as polycyclic aromatics which are difficult to crack. Resids also contain large amounts of metals which rapidly deactivate conventional catalyst. Some attempts at catalytic processing of these stocks have been made e.g., adding relatively small amounts of residual oil to conventional FCC feed. FCC units can tolerate modest amounts of resid in the feed, e.g., 5–10 wt percent but the heavy feeds increase the burning load on the regenerator (because of their high Conradson carbon content) and poison the catalyst, with nickel and vanadium. Limiting the amount of resid in the FCC feed has been the method of choice in controlling regeneration operation, although consideration has been given to adding catalyst coolers. The nickel and vanadium contamination problem can be overcome to some extent by practicing metals passivation, e.g., addition of antimony to the unit to passivate the metals added with the feed. Metals passivation has allowed FCC units to continue operating with catalyst containing relatively high amounts of nickel and vanadium, but has not been a complete solution. The vanadium seems to attack the zeolite structure of modern FCC catalyst, resulting in rapid loss of catalyst activity. The exact cause of vanadium poisoning is not completely understood, but it is believed that oxidized vanadium compounds are formed in the highly oxidizing atmosphere of conventional FCC regenerators and these compounds, particularly vanadic acid rapidly attack the zeolite. The problem is discussed in Vanadium Poisoning of Cracking Catalyst, Wormsbecher et al, Journal of Catalysis, 100, 130–137 (1986).

Most refiners now monitor the metals concentration on their catalyst and dump equilibrium catalyst and replace it with fresh catalyst to control the average level of metal on the catalyst. Such a solution is expensive because it can result in very high catalyst replacement rates.

Another use of residual oils in FCC units is described in U.S. Pat. No. 3,886,060, which is incorporated herein by reference. Residual oil was used as a quench medium to limit the conversion of a recycle oil in a riser conversion zone. The preferred catalysts had dual components, i.e., contained both large and small pore size zeolites. A single regenerator operated with dual riser reactors.

Despite the many improvements which have been made, attempts to crack resids have not been too successful, primarily because of the large amounts of metal and coke associated with such feeds. A better way has now discovered to regenerate catalysts used to crack such difficult stocks. Preferably, a mixture of dense, rapidly settling additive, and conventionally sized FCC catalyst, are regenerated in a two stage regenerator to achieve some unusual results.

By careful selection of the catalyst and additive sizes, and of the superficial vapor velocities in the catalyst regenerator, it is possible to segregate the coarse additive from the conventionally sized FCC catalyst in a primary regeneration stage. The FCC catalyst can be regenerated in a single stage, under relatively mild conditions which minimize oxidation of vanadium compounds on the catalyst but which still remove much of the hydrogen content of the coke and eliminate most of the water precursors. The additive is regenerated to some extent in the first stage regenerator, but then undergoes a second stage of regeneration, preferably at a higher temperature, in a second stage regenerator. Use of two different kinds of catalyst, in a two stage regenerator, permits significantly higher metals levels to be tolerated in the feed, and/or more efficient operation of the regenerator.

BRIEF SUMMARY OF THE INVENTION

Accordingly, the present invention provides an improved process for the regeneration of a conventionally sized fluidized catalytic cracking (FCC) catalyst in a primary regenerator comprising a vessel having an inlet for a stream of spent, coked, FCC catalyst, an inlet for oxygen-containing gas for regeneration of the catalyst, an outlet for flue gas and an outlet for regenerated catalyst, wherein the spent catalyst is added to the primary regenerator and maintained therein as a dense phase, fluidized bed CHARACTERIZED BY a second stage regenerator comprising a second vessel containing a dense phase fluidized bed of catalyst, the second stage regenerator having a particulate inlet connective with a lower outlet in the dense phase bed of the primary regenerator, a secondary air inlet connective with a supply of oxygen-containing gas and the dense bed of particulates maintained in the second vessel, an outlet for regenerated particulates connective with the base of the dense bed in the secondary regenerator, and a secondary flue gas outlet which is connective with and discharges into the primary regenerator. In another embodiment, the present invention provides an apparatus for burning coke from coke-containing particulates comprising: a primary regenerator having an inlet for coke-containing particulates, an inlet at a lower portion thereof for an oxygen-containing regeneration gas stream, an upper outlet for removal of flue gas, a decoked particulate outlet at an intermediate portion thereof, and a lower outlet in a lower portion of the regenerator for removal of particulate matter from the primary regenerator to a secondary regenerator; a secondary regenerator comprising an inlet for particulates connective with the lower portion of the primary regenerator, an inlet for an oxygen-containing regeneration gas stream, an upper outlet for removing flue gas from the secondary regenerator connective with the primary regenerator and an outlet at the base of the secondary regenerator for withdrawal of decoked particulate matter from the base of the secondary regenerator

BRIEF DESCRIPTION OF THE DRAWING

The single FIGURE is a schematic illustration of a preferred embodiment of the two stage regenerator of the invention.

DETAILED DESCRIPTION

A simplified, schematic illustration of an FCC regenerator of the prior art (Vessel A) with the modifications necessary to effect two stage regeneration (Figure B) is shown in the FIGURE. The modifications are shown in dotted lines, as Vessel B, Vessel No. 301. The prior art portion of the FIGURE (vessel A) will be discussed first.

The conventional FCC regenerator 1 receives spent catalyst via line 40. Air, or oxygen enriched gas, is added via line 10 to the base of the regenerator and distributed by air grid means 20. Carbonaceous material on the catalyst is burned. Flue gas passes through primary cyclone 51 and secondary cyclone 52, which recover entrained catalyst from flue gas. Flue gas is discharged into plenum 60 and removed via line 70 for discharge to the atmosphere or other use.

The catalyst is maintained as a single dense bed 260 within the regenerator. Regenerated catalyst is withdrawn via line 30 for reuse in the catalytic cracking unit.

The modifications necessary to achieve two stages of regeneration, and also to permit regeneration of two different catalyst phases, are noted by dotted lines. Although operation with a relatively heavy or at least fast settling additive is preferred, it is not essential. Two stages of regeneration of conventionally sized FCC catalyst is beneficial. For convenience, the discussion below assumes that an extra catalyst is present, an additive catalyst with a significantly higher settling velocity which forms an additive rich lower dense bed when a mixture of conventionally sized FCC catalyst and additive are both present in a fluidized dense bed. For simplicity, the terms "additive phase" and "additive catalyst" will be used herein to describe this faster settling material.

An additive phase catalyst outlet 340 is provided at the base of primary regenerator 1. Additive phase fluidized catalyst is withdrawn and added to Vessel B the additive regenerator 301. Air, or oxygen rich gas is added via line 210 and distributed via air distributor 220 to contact the additive phase material withdrawn from regenerator 1. Additional fluidizing gas, such as inert flue gas or nitrogen, may be added via line 212 to assist in fluidization of the additive phase material in Vessel B.

Additional combustion of carbonaceous deposits occurs in Vessel B. The additive phase material added via inlet 40 to regenerator 1 tends to settle rapidly in regenerator 1 to form dense phase additive rich bed 250. Some coke combustion from additive occurs in Vessel A, but the additive usually contains more coke than the conventionally sized FCC catalyst. For this reason, additive should usually be subjected to additional regeneration in Vessel B. Conditions in the two regenerators can also be adjusted to optimize operation of the catalytic cracking unit. Additive materials may be selected more for their metals affinity, rather than their catalytic cracking activity. These additives can usually tolerate higher temperatures than the conventional catalytic cracking catalyst. Thus, conditions in Vessel B are not so constrained as in Vessel A.

After the additive phase is regenerated in Vessel B, some of it is removed via overhead line 302 which discharges via outlet 310 into the regenerator 1. This allows any light, conventionally sized FCC catalyst entrained with the additive to be returned to regenerator 1. Quite a lot of additive may be returned via line 302 and outlet 310 to regenerator 1. This transfer of flue gas and solid, allows some of the heat of coke combustion in Vessel B to be transferred to Vessel A.

Some or all of the additive, or the heavy, dense phase catalyst is withdrawn via line 230 from Vessel B and charged to the FCC reactor, not shown.

Preferably, the two regenerated catalyst phases, the conventionally sized FCC catalyst withdrawn via line 30, and the additive withdrawn via line 230, are charged to different elevations of a riser reactor (not shown in the figure).

The two regenerated catalyst streams, in line 30 and line 230, may also be combined, and charged simultaneously to a conventional FCC riser reactor.

The process conditions in vessel A include a temperature of about 1100 to 1500 F., preferably 1150 to 1450 F., and most preferably 1200 to 1400 F. The superficial vapor velocity should be low enough to maintain generally dense bed conditions, typically this will mean a velocity of less than 4 or 5 fps, preferably 1 to 3.5 fps, and most preferably about 1.5 to 3.0 fps.

The catalyst residence time in vessel A will be relatively long, almost always in excess of 1.0 minutes, and preferably 2 to 10 minutes, with 3 to 7 minutes of catalyst residence time giving good results.

There is preferably little or no excess oxygen in the flue gas. Operation with less than 2.0 volume % oxygen is preferred, with 0.1 to 2.0 volume % O2 giving good results. Preferably the flue gas contains 0.2 to 1.0 volume % O2.

In vessel B, the operating conditions are much more severe. Temperatures well in excess of those customarily used in FCC regenerators are preferred, with a 1200–1800 F. temperature giving good results. Preferably, the temperature in Vessel B is 1300–1750, with a 1400–1700 F. temperature being most preferred.

The superficial vapor velocity in this vessel is at least 25% higher than the superficial vapor velocity in Vessel A. Operation with higher vapor velocities leads to intense fluidization, with little of the large bubble which characterize the operation of Vessel A. The Vessel B superficial vapor velocity is preferably above 5 fps, with 5–40 ft/sec giving very good results.

The catalyst residence time in Vessel B is preferably no more than 50% of the catalyst residence time in Vessel A, with 2–5 minutes of catalyst residence time giving good results.

Enough oxygen or oxygen containing gas will be added to have a highly oxidizing atmosphere. The flue gas should contain at least 0.5 volume % O2, and preferably contains 1–15 volume % oxygen, and most preferably 2–5 volume % oxygen.

Vessel B can function to some extent as a thermosiphon reboiler, with operation varied to suit changing conditions. Where it is desired to shift coke combustion, and heat generation, out of Vessel A, it is possible to do so by restricting air supply to Vessel A and burning more coke in Vessel B. The amount of air added via line 210 largely determines the amount of coke combustion that occurs in Vessel B. Whether the heat of coke combustion is returned to the FCC reactor directly (by withdrawing hot decoked additive via line 230) or returned to the FCC reactor indirectly (via recycle of additive to the conventional regenerator) can be determined by varying the amount of additive recycled from Vessel B to Vessel A, via line 302 and outlet 310.

A small amount of FCC catalyst will usually be recycled from Vessel B to Vessel A due to entrainment of FCC catalyst in the flue gas generated by combustion in Vessel B. This minimum amount of entrainment is highly beneficial, because it allows prompt removal of relatively fine, conventionally sized FCC catalyst which entered Vessel B along with the additive.

There is no upper limit on the amount of heat generated in Vessel B which can be returned to Vessel A. Depending on the geometry of Vessel B and return line 302, and on the amount of inert gas added, it is possible to return more additive to Vessel A than is removed via line 230 for reuse in the catalytic cracking process. Addition of relatively large amounts of fluidizing gas and/or maintaining a high additive dense bed level in Vessel B, up in the narrow portion 305 of Vessel B, promotes recycle of the catalyst and additive from Vessel B to Vessel A. Preferably, no more than 90% of the solid material entering Vessel B is recycled to Vessel A, with at least 10-99% of the material being returned via line 230 to the catalytic cracking zone.

It is possible to have extremely high temperatures in the additive regenerator, Vessel B, temperatures much higher than could be accommodated in a conventional FCC regenerator (Vessel A). High temperatures can be accommodated in Vessel B for several reasons. The additive need not be chosen for its high cracking activity, but rather for its metals affinity. This additive can tolerate very high temperatures, without loss of catalyst activity. Additive catalytic activity will be reduced to some extent by the high temperature regeneration occurring in Vessel B, but this loss of catalyst activity does not impair the usefulness of this material as a metals getter or metals sink. High temperatures can also be tolerated in Vessel B because it is relatively dry in Vessel B. The hydrocarbonaceous coke deposits remaining on additive phase material charged to Vessel B will be almost completely free of labile hydrocarbons, and will (because of at least partial combustion in Vessel A) have extremely low hydrogen contents. Conventional coke on FCC catalyst contains 8-12% hydrogen in the "coke". The additive phase removed from the bottom of dense bed 250 of Vessel A will have much lower hydrogen contents, usually less than 8%, and frequently 2-6 wt. % hydrogen, or less, in the coke. When this additive phase coke is burned, there is very little water of combustion formed, so very low water pressures are noted in Vessel B. Vessel B is also well isolated from water added via entrained stripping steam, which entrained steam enters Vessel A via spent catalyst inlet line 40. This steam is rapidly displaced from catalyst, and additive, by flue gas. Little entrained stripping steam remains in additive phase bed 250. This combination of factors, an additive which does not require much catalytic activity, and can tolerate high temperatures, a relatively dry atmosphere, permit extraordinarily high temperatures to be tolerated in Vessel B. These high temperatures will not automatically be reflected by higher temperatures in Vessel A, e.g., if 80% of the additive entering Vessel B is withdrawn via line 230, rather than recycled via line 302, then most of the heat of combustion will be removed in the form of hotter additive phase catalyst.

Typical operating conditions in Vessel A will approach those of conventional FCC units, e.g., operation at 1100°-1400° F., but more usually at 1200°-1350° F. The additive bed material will be withdrawn from line 340 at a temperature roughly equal to that of the average temperature in Vessel A.

Use of Vessel B also improves operation when no additive material is used. Zeolite FCC catalysts, generally have greater thermal than hydrothermal stability, so catalyst will last longer when some regeneration occurs in Vessel B.

In Vessel B the hot additive will be rapidly decoked by the addition of air via line 210, and get hotter. Combustion can be partial CO combustion, full CO combustion, or anywhere in between. There will usually be a temperature rise of at least 50° F. in Vessel B and more usually a temperature rise of 100°-200° F., or even more depending on the ability of the equipment to withstand a high temperature rise, the ability of the additive process. Usually Vessel B will operate at 1200°-1600° F., and preferably at 1350°-1450° F.

Preferably, a majority of the dense phase material entering Vessel B is withdrawn via line 230. This means that roughly half of the heat of combustion associated with the operation of Vessel B will be removed in the form of hotter additive removed via line 230. One half, or less of the heat of combustion will be returned to Vessel A in the form of hot flue gas, entrained conventionally sized FCC catalyst, and some additive which is recycled to Vessel A.

Although not shown in the drawing, it is possible, and may be beneficial, to operate with one or more heat removal means in Vessel A or in Vessel B or in both. In Vessel A, one or more steam coils, or other heat exchanger means may be provided in the additive phase, lower dense bed 250, upper dense bed 260, or in the dilute phase region above bed 260.

In Vessel B, a heat removal means such as a heat exchanger may be provided in line 340, line 230, at the base of Vessel B, or in the Vessel B outlet, line 302.

Additional air injection means may be provided at various places within the regenerator. In Vessel A, it may be beneficial to add more combustion air at intermediate elevations of Vessel A, both in the lower dense bed 250 and in the upper dense bed 260. Additional combustion air may be added at multiple elevations in the base of Vessel B, and in the transition section 305.

Outlet 310 may be located in close proximity to outlet line 30 and its hopper, facilitating the preferential removal of fine material transported back to vessel A from vessel B via line 30.

The process and apparatus of the present invention provides a way to efficiently decoke both conventionally sized FCC catalyst, and metals getting additive. Only relatively minor modifications to an existing, single dense bed FCC regenerator are needed to practice the present invention. The extremely hot getter additive which can be produced is useful not only for adsorbing metals and Conradson carbon material in the feed, but also for pretreating a resid feed. High temperature additive, or high temperature catalyst, seems to shock resid feeds into more readily crackable states.

CO COMBUSTION PROMOTER

The process and apparatus of the present invention may be used with CO combustion promoter on the conventionally sized FCC catalyst, on the relatively heavy, dense phase additive, or on both materials.

The present invention permits innovative use of conventional CO combustion promoters. CO combustion promoters, such as 0.01–100 ppm platinum group metal, preferably 0.02–5 weight ppm platinum, may be added to the conventionally sized FCC catalyst, the heavy, dense bed material, or both.

When CO combustion promoter is added only to the conventionally sized FCC catalyst, it is possible to obtain Vessel A. Complete CO combustion in Vessel A, and the intense, oxidizing atmosphere associated therewith, ensures that the conventionally sized FCC catalyst will be regenerated to a very low carbon level. The intensely oxidizing atmosphere will promote operation of $SO_x$ adsorbing materials (such as alumina), to minimize $SO_x$ emissions. There will be a significant reduction in $NO_x$ emissions over those which would be achieved in a single dense bed regenerator, e.g., Vessel A only, because much of the nitrogenous coke will be burned in Vessel B under generally reducing conditions. $NO_x$ formed in Vessel B, and in the lower portion of Vessel A, in dense bed 250, will be rapidly reduced with carbon monoxide to nitrogen. Finally, the design of Vessel B will be simplified, because less air or oxygen-containing gas will be required (for partial CO combustion as opposed to complete CO combustion) and there will be significantly less heat release in Vessel B from partial CO combustion. The CO produced in Vessel B will be discharged to Vessel A, and preferably into the dense bed 260 of conventionally sized FCC catalyst where the heat of CO combustion may be released to the FCC catalyst. To accommodate this additional heat generation in Vessel A, it will usually be necessary to add catalyst coolers to bed 260, or some other equivalent heat exchange means on line 302.

When CO combustion promoter is added only to the heavy, dense phase material, and not to the conventionally sized FCC catalyst, it is possible to promote extremely high temperatures in Vessel B, by achieving complete CO combustion therein, and operate with partial CO combustion in Vessel A. Such a mode of operation is desirable when the coke loading of the additive is so high that it is not possible to accommodate all of the heat release in Vessel A. This also permits the extremely high temperature operation of Vessel B, needed to generate high temperature additive to thermally shock the resid feed, even when such high temperatures can not be tolerated by the conventionally sized FCC catalyst. In this mode of operation, the flue gas stream removed via line 70 will contain significant amounts of carbon monoxide. Use of a CO combustion boiler for the regenerator flue gas will be needed for heat recovery. In some units, it will be cheaper to shift heat generation to a CO combustion boiler (which may already be available in the refinery) rather than install heat exchangers in Vessel A and Vessel B. Such a mode of operation will also significantly reduce $NO_x$ emissions, because although relatively high amounts of $NO_x$ will be formed in Vessel B (due to the high temperature, oxidizing combustion conditions therein) much of the $NO_x$ formed will be reduced to nitrogen in the generally reducing atmosphere in Vessel A.

It is also possible to operate with both phases of solids fully promoted. This permits fairly high temperature operation in both Vessel A and in Vessel B (with temperature controlled by heat exchange means as desired). Partial combustion may still be obtained in either Vessel A or Vessel B by carefully controlling the amount of air or other oxygen containing gas added to the unit.

Selective promotion of one or the other of the catalyst phases may be obtained by using e.g., a Pt containing make-up catalyst having the desired particle size and fluidization characteristics to send a promoter into the desired catalyst phase. A liquid solution of CO combustion promoter may be added to a region of the FCC regenerator, or FCC unit, which contains primarily one or the other of the catalyst phases. A chloroplatinic acid solution could be sprayed into Vessel B, to selectively promote the heavy, dense phase additive. Chloroplatinic acid could be sprayed into dense bed 260, to selectively promote CO combustion of the conventionally sized FCC catalyst.

CATALYST MIXTURE

It is preferred to use a catalyst mixture of "fine" and "coarse" material which can be readily separated by elutriation in the regenerator. The "fine" catalyst will have a relatively high activity and usually have a smaller particle size than the coarse catalyst. The additive or "coarse" catalyst will usually have low catalytic activity, and a high vanadium affinity.

The fine catalyst is preferably a conventionally sized FCC catalyst, e.g., a composite of 5–50 weight percent high activity zeolite in an amorphous matrix. The conventional FCC catalyst may be any commercially available, or hereafter developed, FCC catalyst. Catalysts designed to process residual stocks can be used very well as "fine" or conventionally sized FCC catalysts in the practice of the present invention, although use of the specialized catalyst is not necessary. All amorphous catalysts can also be used, but zeolite based catalysts are preferred. Especially preferred are catalysts containing both large pore zeolites (such as zeolite X and zeolite Y) and intermediate-pore zeolites (such as ZSM-5, ZSM-11 and similar materials). Super stable forms of zeolite Y, such as Ultrastable Y (USY) are preferred. When mixtures of intermediate pore and large pore zeolites are used, it is not necessary that they be in the same particle, although both catalysts should have about the same particle size distribution.

Specialized catalysts for resid conversion can be used. Typical of the specialized catalysts is RCCC-1, the preparation of which is disclosed in European Patent Application EP 0 074 501 A2. Another catalyst which is useful for converting resids is disclosed in U.S. Pat. No. 4,407,714, which is incorporated by reference.

Typical FCC catalysts have an average particle size of around 60 microns diameter, although individual units and catalyst manufacturers can cause quite a variation. Conventional FCC catalysts will have little or no catalyst with a particle size less than 20 microns. Usually 5–25 weight percent of the catalyst particles will be 40 microns or less. Typically 60–100 percent of the particles are 80 microns in size or less.

The coarse or additive particles may be made of the same material as the conventional FCC catalyst, simply having a larger particle size. They may also be about the same size, but much denser. A combination of size and density may also be used to achieve more rapid settling of "coarse" catalyst in the regenerator. Use of a relatively large, low density, soft material as a coarse catalyst may be preferred when charging feeds with exceptionally high metals contents. The large, light materials can be made to settle rapidly, but being less dense they will usually be subject to rapid attrition and wear. They will become rapidly saturated with metals, break down into finer particles called "fines", and very shortly thereafter the fines will be discharged from the regenerator with the flue gas for recovery in a downstream electrostatic precipitator, cyclone separator, or the like.

Usually the size of the conventional FCC catalyst will be fixed to correspond to that conventionally available. This will make for cheap sources of supply, and permit use of existing stocks of equilibrium catalyst for starting up the unit. The size, shape, and density of the coarse catalyst should be selected so that a majority of the coarse catalyst settles to the bottom or additive phase of Vessel A in 100 seconds, more preferably within 30 seconds stage regeneration zone while a majority of the conventionally sized FCC is retained above the additive phase catalyst. Efficiency of separating coarse from fine catalyst can be enhanced by proper design of the regenerator, and the inlet for stripped catalyst.

As a general guideline, the terminal velocity of the additive catalyst should be at least 50 percent greater, and preferably 100 percent greater, than the terminal velocity of the conventionally sized FCC catalyst particles. The terminal velocity of a typical FCC catalyst particle of 75 micron diameter is 0.2 feet per second, so the terminal velocity of the coarse catalyst should be at least 0.3 feet per second and more preferably is 0.4 to 5 feet per second.

The coarse particles must have a faster settling rate than the conventional FCC catalyst, but the coarse particles must also be readily fluidizable. Fairly coarse particles, e.g., 100–250 micron range particles can be readily fluidized in the process of the present invention because of the presence of large amounts of conventional FCC catalyst which promotes fluidization of the coarser particles.

Preferably, the settling velocity of the coarse particle, does not exceed the superficial velocity in the riser. For most risers, the superficial vapor velocity is 40 to 100 feet, per second. This will usually limit the maximum particle size of the additive to 1.5 to 6 mm, presuming the material has an apparent bulk density similar to that of conventional FCC catalysts.

The coarse or additive catalyst properties should be selected to maximize removal of metals and carbonaceous materials. The additive catalyst incurs little penalty for having low catalytic activity. If the catalyst had high activity, it would rapidly lose it due to coke and metals deposition.

Either the coarse catalyst or the fine may include antimony, tin, bismuth or other materials to act as metal passivators. Antimony compounds may be added to the feed. The catalyst or the coarse additive may include a vanadium scavenger such as that described by Wormsbecher et al in the paper presented at the Ninth North American Catalyst Society Meeting, Houston, TX, Mar. 18–21, 1985.

The coarse catalyst can also be a material which is relatively cheap, such as naturally occurring clays, catalyst fines from other refinery processes, coke from delayed or fluid cokers, etc.

MgO (magnesium oxide) or CaO (calcium oxide), with a minor amount of other matrix materials such as silica or alumina, should give an additive particle with ideal properties. The MgO and CaO are inherently soft and light and would attrit rapidly and would be elutriated from the unit as metals deposited on it.

Although the use of cheap, efficient metal scavengers is preferred and permitted by the present invention, it is not essential to use such scavengers. Larger particles of catalyst having the same composition as conventional FCC catalyst can also be used with good results. Spent hydrotreating or hydrocracking catalyst can be used, so long as it has the proper fluidizing properties.

The specialized, high activity, resid-conversion catalyst discussed above (such as RCCC-1) may be used as the coarse catalyst. Such catalysts have very desirable pore size distributions, however they are fairly expensive because, inter alia, they contain 30–40% zeolite. Most or all of the zeolite content can be eliminated from the coarse catalyst contemplated for use herein.

I claim:

1. A process for the two stage regeneration of a stream of coke containing particulates including coked fluidized catalytic cracking (FCC) catalyst from a cracking reactor comprising:

charging said stream of fluidized solids comprising coked FCC catalyst to a primary regenerator vessel having a bubbling dense bed of fluidized solids and:

an inlet for said coked FCC catalyst;

an inlet for oxygen-containing regeneration gas in a lower portion of said bubbling dense bed, an inlet within said bubbling dense bed for a flue gas and entrained catalyst stream from a secondary vessel;

an outlet in an upper portion of said primary vessel above said bubbling dense bed for flue gas removal from said primary vessel, a regenerated catalyst outlet within said bubbling dense bed for removal of regenerated FCC catalyst, and a lower outlet in a lower portion of said bubbling dense bed connective with a secondary regenerator vessel;

at least partially regenerating said coked FCC catalyst in said primary regenerator at FCC catalyst regeneration conditions including a temperature of 1100 to 1500 F. and a superficial vapor velocity of less than 5 fps and sufficient to maintain said coked FCC catalyst as a dense phase, bubbling fluidized bed of solids, to produce at least partially regenerated FCC catalyst;

removing regenerated FCC catalyst from said primary vessel regenerated catalyst outlet and recycling it to an FCC cracking reactor;

withdrawing from said primary vessel lower outlet a fluidized solids stream containing partially regenerated FCC catalyst and charging same to a secondary catalyst regenerator vessel having:

a fluidized solids inlet connective with the lower outlet of the primary regenerator, an inlet for oxygen-containing regeneration gas in a lower portion of said secondary vessel, a flue gas outlet in an upper portion of said secondary vessel connective with an immersed within said bubbling fluidized bed in said primary vessel, and a fluidized solids outlet in a lower portion of said secondary vessel connective with said FCC cracking reactor;

regenerating in said secondary vessel said partially regenerated FCC catalyst at catalyst regeneration conditions including a higher temperature than said primary vessel, and a superficial vapor velocity at least 25% higher than the superficial vapor velocity in said primary vessel and sufficiently high to maintain a bed of fluidized solids in said secondary vessel and to entrain from said bed of fluidized solids at least a portion of the FCC catalyst charged to said secondary vessel, to produce a secondary vessel flue gas stream containing entrained, regenerated FCC catalyst;

recycling said flue gas and entrained regenerated FCC catalyst from said second vessel back to said bubbling fluidized bed in said primary vessel; and removing fluidized solids withdrawn from said fluidized solids outlet of said secondary vessel and recycling same to said FCC reactor.

2. The process of claim 1 wherein the stream of coke containing particulates entering the primary regenerator comprises 40 to 80 micron sized FCC catalyst having a settling rate and an additive material having a particle size greater than 100 microns which is fluidizable and has a faster settling rate than the FCC catalyst and is separable therefrom by elutriation in the primary regenerator to form a two-phase dense bed, a lower dense bed enriched in additive and an upper dense bed enriched in FCC catalyst and wherein the lower outlet of the primary regenerator is in said lower dense bed.

3. The process of claim 2 wherein the regenerated FCC catalyst is withdrawn from the primary regenerator upper, dense phase bed.

4. The process of claim 1 wherein the secondary regenerator has an inlet for inert, fluidizing gas in the base thereof.

5. The process of claim 1 wherein the secondary regenerator flue gas outlet discharges into the upper dense bed FCC catalyst, in the primary regenerator.

6. The process of claim 1 wherein a CO combustion promoter is present.

7. The process of claim 1 wherein a heat removal means is present in at least one of the primary or additive regenerators.

8. A process for the two stage regeneration of a stream of coked fluidizable solids from an FCC reactor, said stream comprising an elutriable mixture of fluidized catalytic cracking (FCC) catalyst having an average particle size within the range of 40 to 80 microns and a settling velocity at FCC catalyst regeneration conditions; and fluidizable coarser particles having an average particle diameter in excess of 100 microns and having a higher settling velocity than said FCC catalyst;

and charging said elutriable mixture to a primary regenerator vessel and forming therewith a dense phase bubbling fluidized bed, and elutriating therein said mixture within said dense phase bubbling fluidized bed into an upper phase FCC catalyst rich dense phase fluidized bed and a lower phase coarse particle rich dense phase fluidized bed, said primary regenerator vessel having:

an inlet for said coked, elutriable solids mixture, an inlet for oxygen-containing regeneration gas in said coarse particle rich lower phase, an inlet within said FCC catalyst rich phase of said bubbling dense bed for a flue gas and entrained FCC catalyst stream from a secondary vessel, a flue gas outlet in an upper portion of said vessel above said bubbling dense bed for flue gas removal of said primary vessel, a regenerated FCC catalyst outlet within said FCC catalyst rich, upper dense phase of said bubbling dense bed for removal of regenerated FCC catalyst, and a lower outlet in said lower phase coarse particle rich, lower dense phase fluidized bed connective with a coarse particles secondary regenerator vessel;

regenerating and elutriating said coked FCC catalyst and coarser particles in said primary regenerator at FCC catalyst regeneration conditions including a temperature of 1100 to 1400 F. and a superficial vapor velocity of less than 5 fps and sufficient to form an upper dense phase, bubbling fluidized bed of at least partially regenerated FCC catalyst and a contiguous lower dense phase, bubbling fluidized bed of coarser particles and entrained FCC catalyst;

removing regenerated FCC catalyst from said primary vessel regenerated catalyst outlet and recycling it to an FCC cracking reactor;

withdrawing from said primary vessel lower outlet a fluidized solids stress of coarser particles and entrained FCC catalyst and charging same to a coarse particles secondary regenerator vessel having:

a fluidized solids inlet connective with the lower outlet of the primary regenerator, an inlet for oxygen-containing regeneration gas in a lower portion of said coarse particles regenerator, a flue gas outlet in an upper portion of said coarse particles regenerator connective with and immersed within said bubbling fluidized bed in said primary vessel, and a fluidized solids outlet in a lower portion of said coarse particles regenerator connective with said FCC cracking reactor;

regenerating in said coarse particles secondary regenerator said coarse particles and entrained FCC catalyst at catalyst regeneration conditions including a higher temperature than said primary vessel, and a superficial vapor velocity at least 25% higher than the superficial vapor velocity in said primary vessel and sufficiently high to maintain a bed of fluidized coarse particulates in said secondary vessel and to elute from said bed of coarse particulates entrained FCC catalyst, to produce regenerated coarse particles and a flue gas stream containing entrained, regenerated FCC catalyst;

recycling said flue gas stream containing entrained regenerated FCC catalyst from said coarse particles secondary regenerator vessel back to said bubbling fluidized bed in said primary vessel; and removing regenerated coarse particles from said fluidized solids outlet of said coarse particles secondary regenerator vessel and recycling same to said FCC reactor.

* * * * *